US005122335A

United States Patent [19]

Eisenmann

[11] Patent Number: 5,122,335

[45] Date of Patent: Jun. 16, 1992

[54] METHOD OF PRODUCING A GEAR FOR A RING PUMP

[76] Inventor: Siegfried Eisenmann, Conchesstrasse 25, D-7960 Aulendorf, Fed. Rep. of Germany

[21] Appl. No.: 750,802

[22] Filed: Aug. 27, 1991

Related U.S. Application Data

[62] Division of Ser. No. 593,714, Oct. 4, 1990.

[51] Int. Cl.[5] ..... G22F 7/00

[52] U.S. Cl. ..... 419/6; 419/7; 228/107

[58] Field of Search ..... 419/6, 7; 228/107

[56] References Cited

U.S. PATENT DOCUMENTS 4,419,413 12/1983 Ebihara ..... 419/6
4,472,350 9/1984 Urano ..... 419/6

*Primary Examiner*—Stephen J. Lechert, Jr.
*Attorney, Agent, or Firm*—Armstrong, Nikaido, Marmelstein, Kubovcik & Murray

[57] ABSTRACT

A suction controlled gear ring pump effects a continuous decrease of the vacuum occurring in the feed cells of the pump at higher rotational speeds due to the long movement path of the feed cells from the end of the suction region to the beginning of the discharge opening and the thereby occurring diminution of the feed cells. In order to prevent squeeze oil when working at a lower rotating speed, the feed cells positioned successively in the feed direction are connected between the teeth respectively with the neighboring feed cells by overflow channels extending through the gear teeth, check valves in said overflow channels preventing a flow against the feed direction.

3 Claims, 4 Drawing Sheets

Fig.2
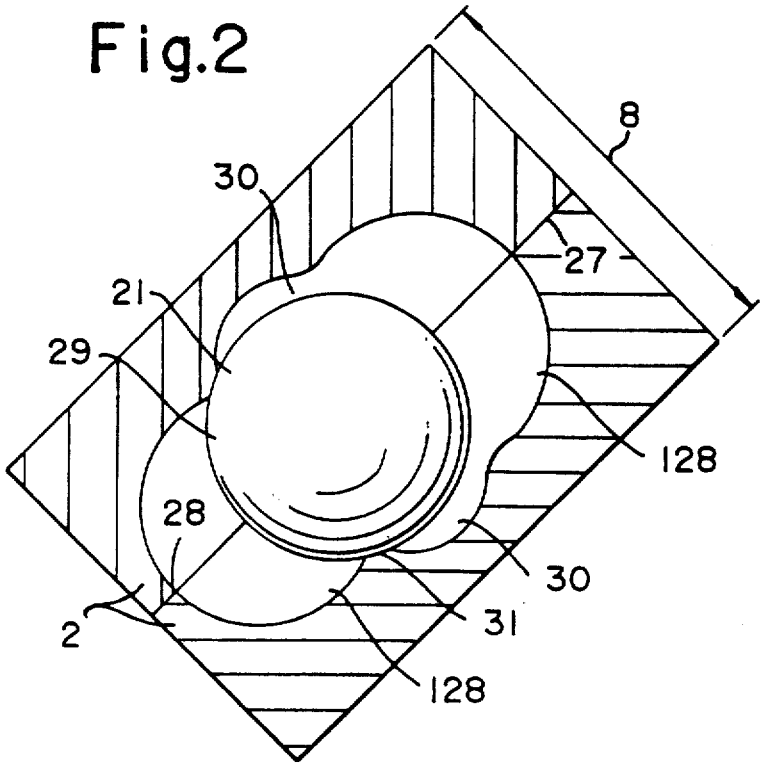
Fig.3
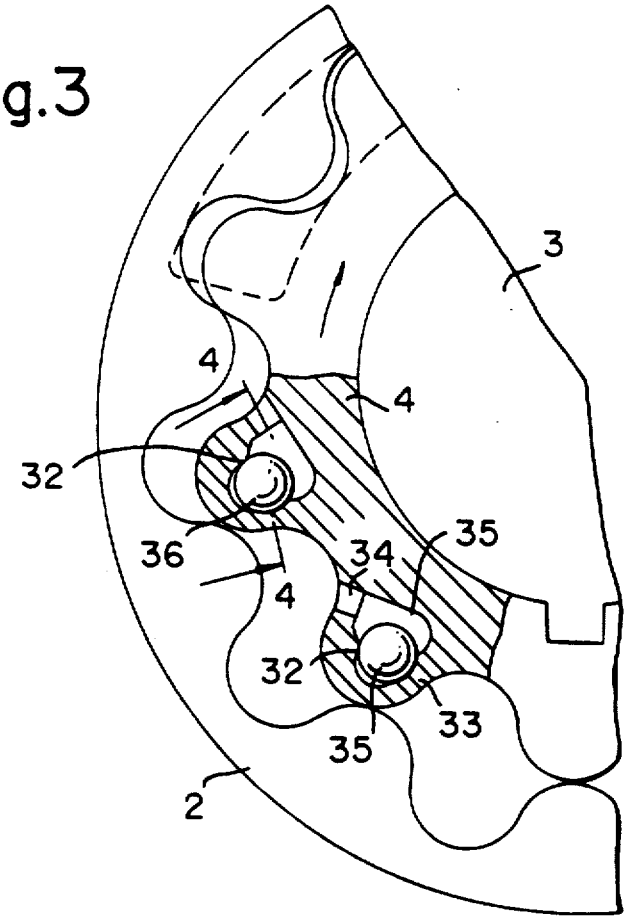
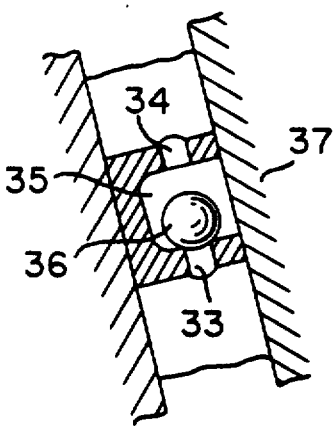
Fig.4

Fig.5
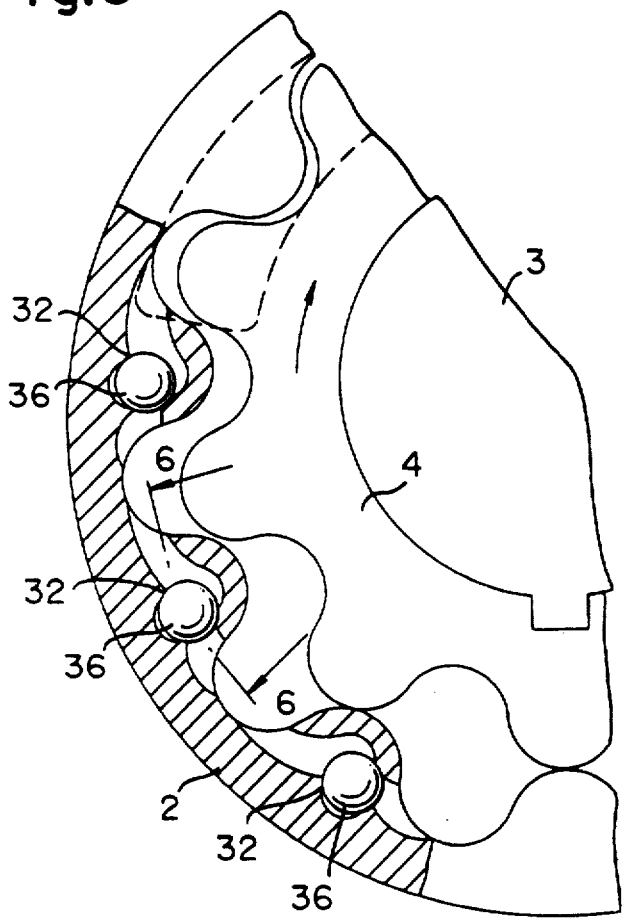
Fig.6
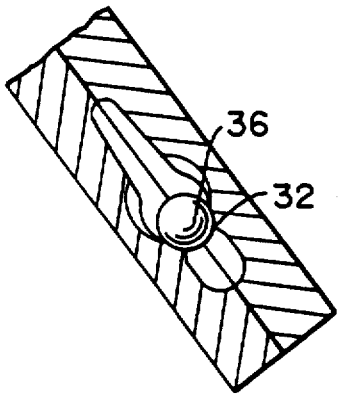
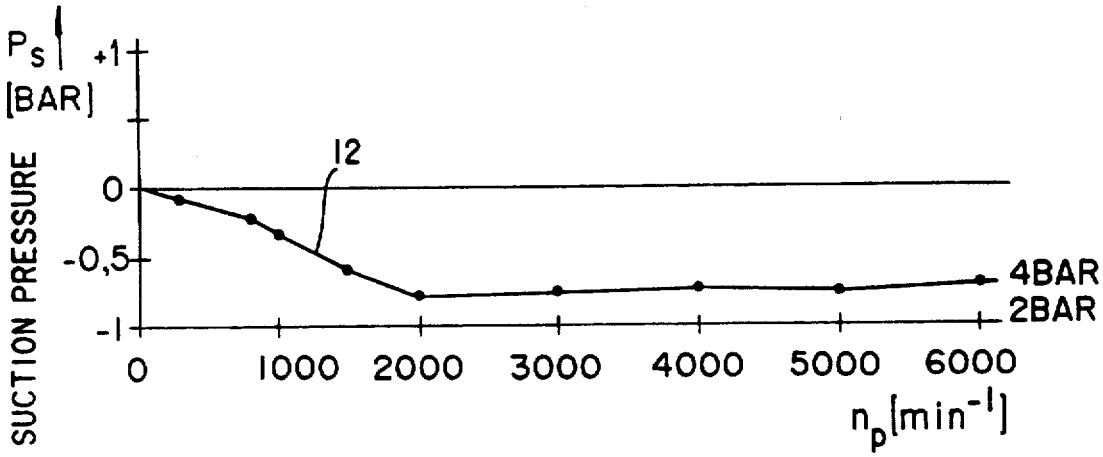
Fig.7B

METHOD OF PRODUCING A GEAR FOR A RING PUMP

This is a division, of application Ser. No. 593,714 filed Oct. 4, 1990.

BACKGROUND OF THE INVENTION

The present invention relates to a suction controlled gear ring pump comprising a housing, an internally geared hollow gear rotatably arranged in a gear box of the housing, a pinion having one tooth less than said hollow gear, engaging with and arranged in said hollow gear, the teeth of said pinion forming, together with the teeth of said hollow gear alternately expanding and reducing successive feed cells for the operating liquid and providing sealing between said feed cells, inlet and outlet ports arranged in the housing for the entry and discharge of the operating liquid, said ports opening out into the gear box on either side of the location of deepest tooth engagement, a fixed or variable throttle provided in the inlet port, and check valves in the pressure region of the pump. As a rule, the drive of the pump is effected by the primary shaft bearing the pinion. For example, such pumps are used for feeding hydraulic systems. The invention especially relates to the use of such a pump as oil and/or hydraulic pump for automobile engines and transmissions.

Especially automobile engines and transmissions are operated at high rotating speeds. The nominal values of the rotating speed can be 10:1 and above.

In contrast, the targeted output of the lubricating feed mechanism of an automobile engine which, in the case of automatic transmissions, additionally has to assume the function of the pressure supply to the hydraulic shift elements and the feeding of the converter against cavitation, is approximately proportional to the rotating speed only in the lower third of the operating range both as far as engines and transmissions are concerned. In the higher,, speed range, the oil requirements increase far more slowly than the rotating speed of the engine. What would be necessary, therefore, is a drive controlled lubricating or hydraulic pump or a pump providing a feed volume which can be adjusted according to the rotating speed. The most common form of such an oil and/or lubricating pump is the gear ring pump, because it is simple, inexpensive and reliable.

The disadvantage is that the feed output (per rotation) is not adjustable, i.e. the theoretical feed quantity is proportional to the rotating speed. The practical characteristics of the feed quantity versus the rotating speed depend on a number of parameters such as feed pressure, oil viscosity, flow resistance in the suction and pressure conduit, teething configuration of the gears, width of the gears and construction of the pump. In most cases, adjustment of the feed line to the consumption line, for example of an internal combustion engine, is too costly, and for this reason a bypass valve is used which by feedback control reduces the excess oil supplied in the case of excess feed at a certain set feed pressure and channels it back into the suction line in decompressed form. Consequently, this type of control results in considerable losses in the control line so that the effectivity decreases in a undesirable way as the rotating speed increases. The only practicable way to avoid this excess quantity which occurs above a certain rotating speed of the pump is suction control. Since the flow resistances increase overproportionally as the oil speed increases, the static pressure in the suction opening of the gear box decreases more and more until the so-called cavitation pressure threshold has been reached, i.e. until it falls below the vapour pressure of the oil. The cell content then consists partly of liquid oil, partly of oil vapour, and partly also of sucked-in air, said cell content being under a static pressure which is significantly below the atmospheric pressure. It is no problem to determine or to control the flow resistances in the suction pipe, for example by using correspondingly narrow suction pipes or a shutter or by regulation with a suction gate valve, in such a way that a high degree of adjustment of the feed quantity of the gear ring pump to the requirement line of the consumer is achieved.

The occurrence of cavitation is the disadvantage of this type of control. For if the cell content which is under a low absolute pressure and consists partly of liquid and partly of gas is abruptly transferred into zones of higher pressure, as is system inherent for such pumps, the gaseous components of the cell content implode with such force that undesirable sounds or, even worse, destruction of the cell walls result.

If a volumetric pump of this type is to be adjusted by throttling on the suction side, then such implosions must be avoided. To achieve this, one uses the known method, namely one provides the cell content on the positive displacement side of the pump, i.e. in the range of the diminishing cells, with sufficient time to sufficiently increase the static pressure by gradual compression in such a way that no implosions of gas bubbles can occur any more at the moment the cell is connected with the discharge port, because said gas bubbles have once again condensated into liquid due to the continuous decrease of the cell volume or have dissolved in the liquid (for example air). Constructively, this solution can be obtained in the most compact way with an internal geared wheel pump where the individual feed cells are separated from each other sealingly. From a construction point of view, the timespan for the slow compression of the vapour and air spaces is assured by the fact that the cells on the displacement side of the pump are at first only connected with the feed pressure space by check valves so that the feed pressure cannot become effective if the cell is not completely filled with liquid.

However, if the cells are already filled completely with liquid on the suction side which, as illustrated above, is the case at lower rotating speeds, then the higher squeeze pressure in the cell opens the check valve towards the pressure feed space so that, at an only slightly increased cell pressure as compared to the feed pressure, the displaced oil can flow into the pressure space according to the opening pressure of the check valve and the flow resistance of said check valves. One such construction is known from German Patent Specification 30 05 657. In that construction, axial bore holes extend over the entire pressure half of the pump in the housing towards the discharge port, said axial bore holes containing, at a distance from the gear chamber, check valves which open only, if the pressure of the cell respectively positioned in front of the relevant bore hole exceeds the pressure in the discharge port. Accordingly, this pump has a large axial extension. The spring valves used there can break. Another disadvantage is the uneven connection of the feed cells to the discharge port. Finally, the pressure distribution is disadvantageous with regard to the occurrence of the cavitation-induced implosions.

SUMMARY OF THE INVENTION

Thus, the invention relates to a suction controlled gear ring pump as explained above wherein the difference of the number of teeth is one and where the tooth shape ensures that the feed cells are sealed from each other.

The invention especially solves the object of providing a short pump having a small diameter and a favourable characteristic in the pressure region. It can be built subsequently into existing constructions to replace the lubricating pump, operates reliably and has a simple design.

This objective is solved by a suction-controlled gear ring pump comprising a housing, an internally geared hollow gear rotatably arranged in a gear box of the housing, a pinion having one tooth less than said hollow gear, engaging with and arranged in said hollow gear, the teeth of said pinion forming, together with the teeth of said hollow gear alternately expanding and reducing successive feed cells for the operating liquid and providing sealing between said feed cells, inlet and outlet ports arranged in the housing for the entry and discharge of the operating liquid, said ports opening out into the gear box on either side of the location of deepest tooth engagement, a fixed or variable throttle provided in the inlet port, and check valves in the pressure region of the pump, wherein the end of the mouth of the discharge port remote from the location of deepest tooth engagement is positioned so close to said location of deepest tooth engagement that several feed cells are present at all times between said mouth end and the circumferential location where said feed cells are beginning to diminish, wherein said feed cells are respectively connected to the neighbouring feed cells by overflow channels provided in at least and preferably one of said gears, and wherein the check valves are positioned in such a way in the overflow channels that they counteract a flow of operating liquid against the feed direction.

By adjusting the feed characteristic to the consumption characteristic, the invention makes it possible in most cases to either dispense completely with the by-pass arrangement having a wide passage used up to now or to replace said by-pass arrangement with a smaller pressure limitation valve.

In inventive embodiment the housing is constructed very simply and has only a very low axial extension. Owing to the fact that even though each feed cell can release operating liquid to the feed cell in front of it during the diminution process of said feed cell, the reverse process is, however, not possible, the pressure in each feed cell in the diminution range of said feed cell can only be increased steadily until the pressure has increased to the value existent in the discharge opening. In that way, the feared implosions are avoided and the cavitation cavities are steadily reduced to zero. It is a special advantage of this construction that a not insignificant flow resistance exists between the neighbouring feed cells owing to the conduits with the ball valves.

The positioning of check valves in the gear teeth per se is known from U.S. Pat. No. 35 15 496.

Basically, for example, the openings of the inlet and discharge ports may have mouths for which space has been provided in the circumferential space of the gear chamber bearing the hollow gear; then the connection between the cells and the conduit mouths is being effected by radial bore holes in said hollow gear. Preferably, however, the mouths of the inlet and discharge ports are positioned at the front walls of the gear chamber as so-called inlet and discharge "kidneys" (claim 2). This permits very large feed and discharge diameters into and from the feed cells.

The overflow channels, for example, can be provided in the gear bodies themselves. However, they are preferably positioned in the teeth of the gears.

The check valves, for example, can be formed by cylindric rolls positioned in relevant broadened parts of the overflow channels and having an axis which is parallel to the pump axis; under the influence of the flow, said rolls position themselves into the broadened part against the relevant channel mouth to be closed. These valves may also be spring loaded valves. Preferably, however, the check valves are formed as ball valves, the ball in each case aiming to press the ball to the valve seat by the centrifugal force of the rotation of the gear containing the valves. This embodiment is not only simple in design, but even simpler to produce and does not require valve springs.

In principle, the overflow channels could for instance be formed as grooves in the front part of the relevant gear, the check valve then being positioned in the broadened part of the groove. In this case, part of the walls of the overflow channels are formed by the relevant front wall of the housing. Insofar, different possibilities exist. According to a preferred embodiment of the invention, however, the gear containing the check valves is formed by two parts (the separating plane of which is a normal plane to the rotating axis of the gear) which each contain half of the valve channels and of the valve seat in laterally or mirror reversed form.

The two halves need not necessarily be joined since they are fixed in their rotating position by the teeth of the corresponding gear; the front walls of the gear chamber prevent any axial movement away from each other.

In this connection it must be taken into account that the gear pump according to the invention having a difference of 1 in the number of teeth is a pump where all the teeth are constantly engaged in the teeth of the counter gear. This guarantees that the two gear halves are guided especially well in circumferential direction. The same, incidentally, applies to the centering.

It is preferred, however, that the two halves of the gear containing the overflow channels and check valves are joined. This joining can, for example, be effected by explosion welding. It goes without saying that the valve bodies must be positioned in the relevant chambers before welding.

Joining of the two halves of the gear by sintering is another possibility. Finally, the two halves of the gear containing the overflow channels can also be joined by axial screws.

The two halves of the hollow gear can be produced conventionally, for example machined or cut from blanks. According to a preferred embodiment of the invention, however, the two hollow gear halves are produced by a powder metallurgy method. This permits to dispense with any subsequent work.

Possible materials for the gears according to the invention can for example be high-strength sintered metals; however, depending on the type of use and the piece number required, steel or gray cast iron are also possible materials.

The valve, bodies—preferably balls—can for example be steel balls. However, preferred are balls of non-metallic material or metal balls coated with a non-metallic material. This counteracts the sticking of the balls on the valve seats. Moreover, use of a non-metallic material also reduces the inertia forces.

According to a preferred embodiment, the overflow channels are positioned in the teeth of the pinion and have a cavity receiving the balls and worked in from one of the axial front walls of the pinion, the inlet and discharge conduits of these cavities then being drilled.

An especially favourable guidance of the balls is obtained if a supporting edge is provided in the check valve, which supporting edge generates a tangentially effective component of the centrifugal force in the direction of the valve seat. This permits a guidance of the overflow channels which is particularly favourable with regard to flow.

The preferred range of application of the invention is the use of the pump as an oil and/or hydraulic pump for automobile engines and/or transmissions, especially automatic transmissions. However, the invention is also suitable for other areas of application, for example hydraulic control systems.

BRIEF DESCRIPTION OF THE DRAWINGS

Other advantages of the invention result from the following description of preferred embodiments and the attached diagrammatic drawings.

In these drawings,

FIG. 2 shows an enlarged partial section along the line A—A through a hollow gear tooth according to FIG. 1, FIG. 3 shows a partial view of a set of gears according to the invention, where the overflow channels are positioned in the pinion and the section also extends approximately through the center of the gear, FIG. 4 shows a section through a tooth of the pinion according to FIG. 3 along the line B—B, FIG. 5 shows a partial view of a further embodiment of the invention, where the section through the hollow gear once again extends through the center of the hollow gear in a normal plane to the axis, FIG. 6 shows a partial section through FIG. 5 along the line C—C, and FIG. 7, finally, shows the measured characteristic lines of a gear ring pump according to FIGS. 1 and 2.

DESCRIPTION OF THE PREFERRED EMBODIMENTS

Figure 1:
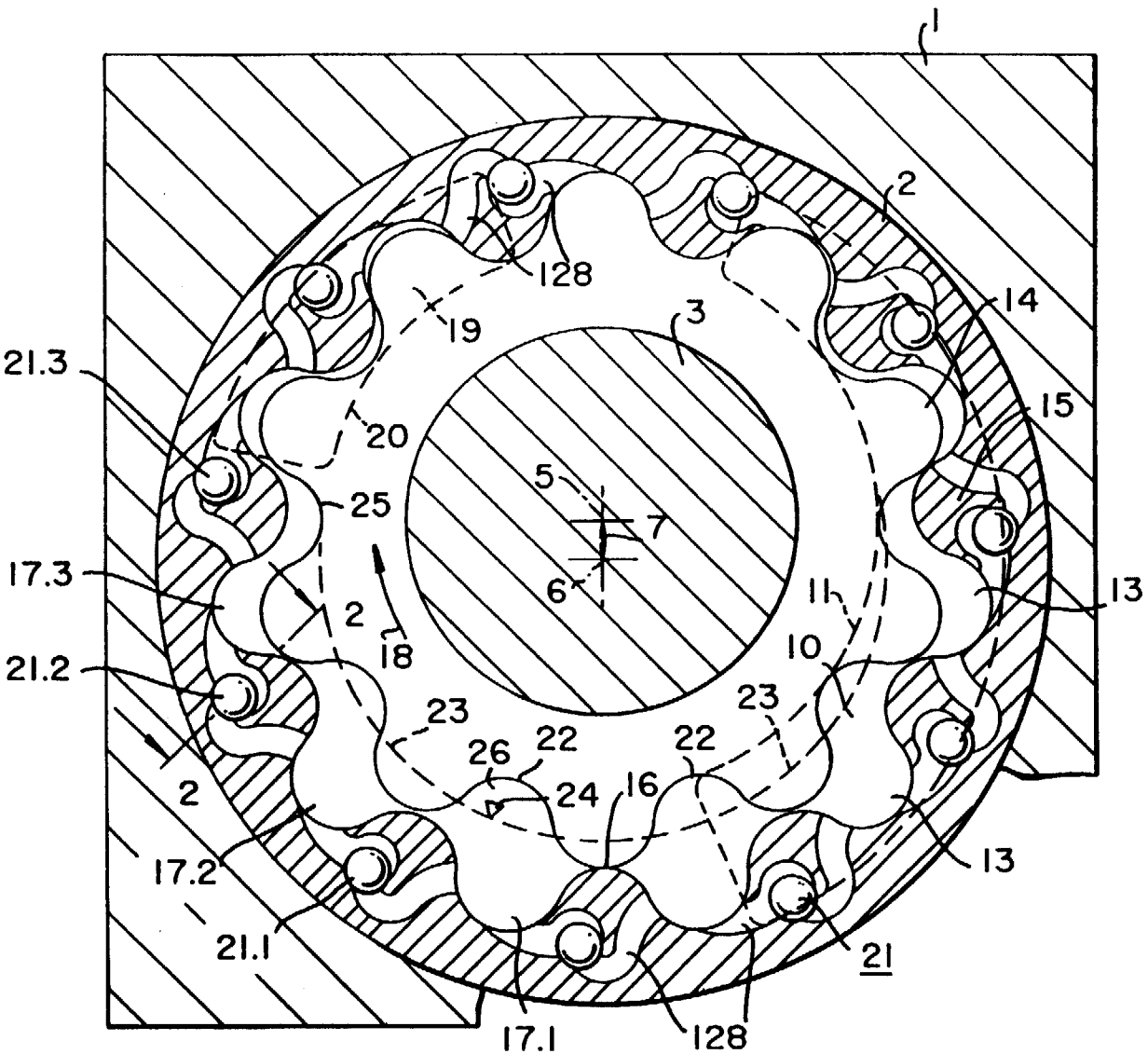
FIG. 1 shows a complete gear ring pump according to the invention in part section in a normal plane to the axes of the gears (the check valves are positioned in the hollow gear; the section extends through the center of the hollow gear)

The pump shown in FIG. 1 has a pump housing 1 illustrated in simplified form, in the cylindric gear chamber of which housing a hollow gear 2 is positioned on the circumferential wall of said gear chamber with its circumference. A shaft 3 bearing a pinion 4 of the gear ring pump is also positioned in the pump housing. However, other bearings are also possible in this respect.

The pinion has one tooth less than the hollow gear so that all the teeth of said pinion are continuously engaged with a tooth of the hollow gear, all feed cells 13 and 17 formed by the tooth gaps of pinion and hollow gear thereby being continuously sealed against the neighbouring cells. The pump rotates clockwise as shown by the arrow 18. In the front wall of the gear chamber positioned behind the drawing plane in FIG. 1 there is provided a suction opening 11 which is shown in dotted lines in the drawing. A discharge opening 19 is also shown in dotted lines on the top of the left-hand half. The suction and discharge openings are formed as so-called "kidneys" here.

Figure 7A:
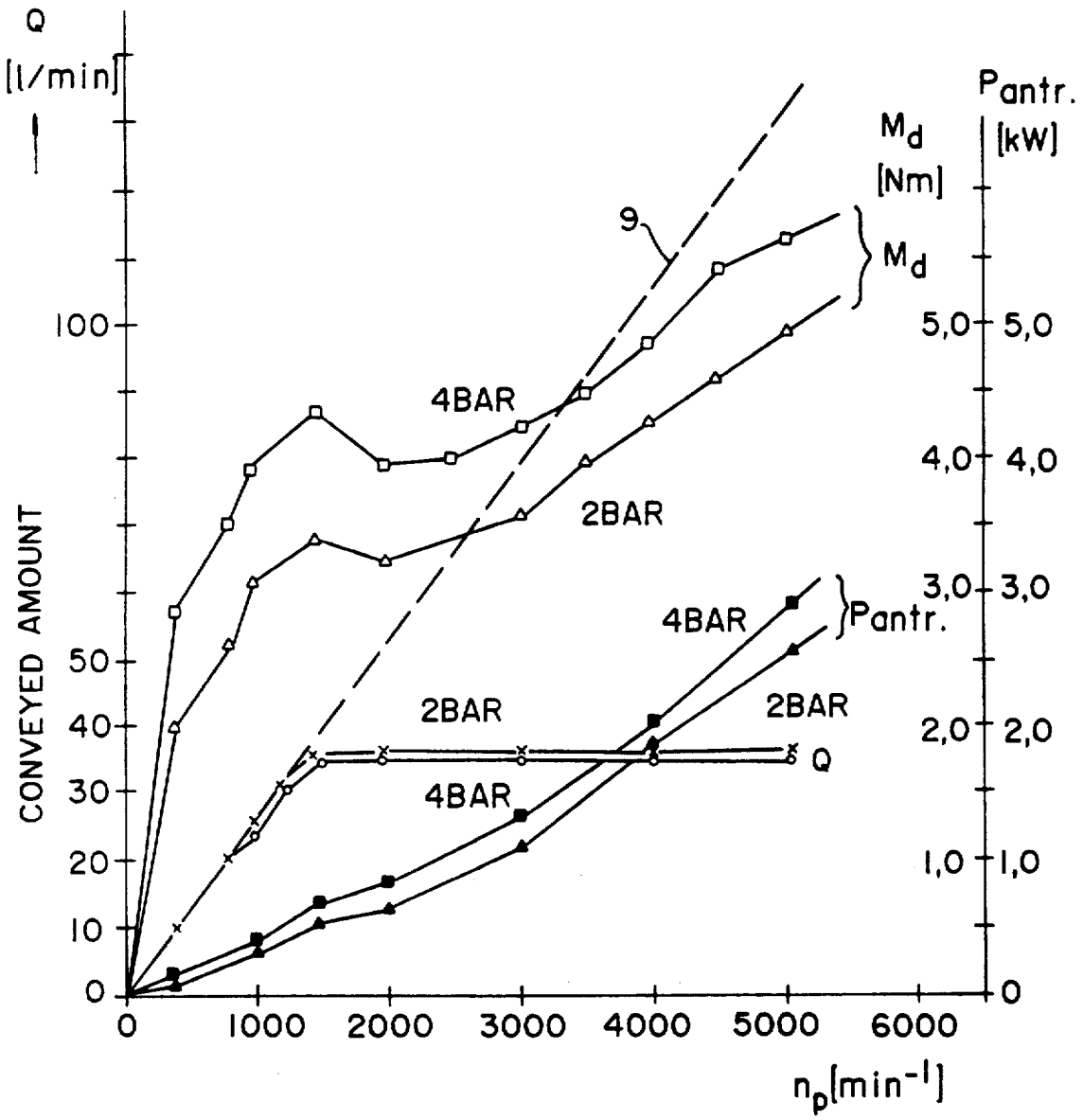

The centers 5 and 6 of the gears 2 and 4 have an axial distance or an eccentrity 7, respectively, which, together with the head circle diameters of the gears, is responsible for the geometrically specific feed volume of the gear set. This is still proportional to the width 8 of the gears. These geometrical values determine the slope of the theoretical feed line 9 of the pump shown by a dotted line in FIG. 7. At a low rotating speed, the suction speed in the inlet port which is not shown here is low, so that the oil can flow free of bubbles into the suction kidney 10 extending almost over the entire suction circumferential range and positioned on the side of the housing, the outlines of which are shown by the dotted line 11, since no substantial sub-atmospheric pressure occurs. The change of this sub-atmospheric pressure is shown at the bottom of FIG. 7 at 12. Since, given this low rotating speed and tooth frequency, the flow impedance between tooth and tooth gap is also low, the suction cells in the positions 13 between the engaged teeth 14 and 15 are filled with oil which is largely free of bubbles. As can be seen from the drawing, the mouth of the inlet port or the suction kidney 10 extends in the circumferential direction close to the point 16 which is diametrically opposed to the location of the deepest teeth engagement. The two feed cells formed by the two opposite teeth gaps have reached their largest volume in the region of this point 16 and are completely filled with oil at low rotating speeds. If the pump continues to revolve and if the feed cells reach the region to the left of point 16 in FIG. 1, the cells in the positions 17 become displacement cells, since, starting from this point up to the location of the deepest teeth engagement, the volume of the feed cells is continuously reduced to almost zero.

In cases of non-controlled gear pumps the discharge opening 19 the outlines of which are shown by the dotted line 20 is also guided close to point 16, that is, as far as possible, but not so far that a substantial short circuit resulting in oil leaks could occur between the suction space and the pressure space. Thus, the feed cells in the positions 17 can release the oil without squeeze losses to the pressure channel already at the beginning of their volume reduction. During this process the discharge opening and therefore also the feed cell in the first position 17.1 is under full feed pressure. In contrast to this, the discharge opening of the gear chamber or the pressure kidney are shortened considerably in the circumferential direction to the location of the deepest teeth engagement in the embodiment of the pump according to the invention, as can also be seen from FIG. 1. During this process the feed cells must be able to empty accordingly also in positions 17.1 to 17.3 when filled with bubble-free oil. This is made possible by overflow channels 128 in the teeth of the hollow gear 2. Each overflow channel 128 is provided with a check valve 21. One recognizes that the feed cells in the positions. 17.1 to 17.3 where their volume is decreasing steadily can release their contents in the feed direction to the pressure kidney owing to the serially positioned overflow channels 128 having the internal check valves 21.1 to 21.3. During this process, a somewhat higher static pressure must prevail in the feed cells in the positions 17.1 to 17.3 than in the discharge opening of the pressure kidney 19, since the overflow channels 128 with the check valves 21 generate losses due to the flow resistance. At low rotating speed these losses are not high since the flow speeds are low. Of course, such losses occurring as a result of throttling should be kept as small as possible by a relevant construction of the check valves.

The mouths of the overflow channels and/or the shape of the teeth and teeth gaps must of course be positioned or dimensioned, respectively, in such a way that a stream of liquid in the direction of the pump rotation at the location of the deepest teeth engagement is prevented. This does not pose any problems.

Up to a certain threshold rotating speed, therefore, the pump according to the invention also supplies a feed quantity which, in principle, is proportional to the rotating speed. Once this threshold rotating speed is exceeded, the static pressure in the feed conduit begins to decrease until it has reached a critical level as can best be seen in FIG. 7. This rotating speed was at approximately 1200 rotations/min. for the examined pump. From 1450 rotations/min. the feed supply stagnates despite an increasing rotating speed, since the static suction pressure has dropped below the evaporation pressure of the oil. From now on, cavities begin to form in the feed cells at the positions 13, which are theoretically concentrated in the region of the foot circle 22 of the pinion 4, since the centrifugal force has caused the bubble-free oil to be displaced radially to the outside. At approximately 2100 rotations/min. the pump only supplies two-thirds of its maximum feed volume, as can be seen from FIG. 7. This condition is illustrated in FIG. 1 by a dotted level line 23 as a circle which is co-axial to the hollow gear center. This level line 23 has been provided with the level number 24. Oil vapour and/or air are essentially present radially inside the level line, oil is essentially present radially outside the level line. The level line 23 crosses the tooth foot point 25 of the feed cell in the position 17.3 which feed cell is on the verge of being connected with the pressure kidney or the discharge opening 19. The pump is preferably designed in such a way that, even at the expected maximum operating rotation speeds, there is no substantial radial shift of the level line to the outside beyond the foot point of the pinion tooth gap of the feed cell which is just beginning to reach the edge of the discharge opening 19.

This level line can of course lie radially further to the inside, provided the suction control is not affected.

Since the feed cells in the positions 17.1 to 17.3 are sealed from each other by teeth flanks or teeth head engagement, respectively, and the check valves in the illustrated construction are closed not only due to the centrifugal force having an effect on the valve ball on the one hand, but also by the static pressure increasing from the cell position 17.1 via 17.2 to 17.3 on the other hand, the feed pressure in the discharge opening 19 cannot have an effect on the feed cells in the positions 17.1 to 17.3. Therefore, the cavities 26 inside the level ring plane 23 have sufficient time to diminish by cell volume, reduction until the position 17.3 is reached, when the cell in said position 17.3 will finally establish contact with the pressure conduit. The much feared cavitation by abrupt implosion of the cavities has thus been avoided.

As can be seen from the position of the level line 23 in FIG. 1, cavitation would have to be expected again at rotating speeds over 2,100 rotations/min., since the filling degree of the pump keeps decreasing from this point onwards as shown in FIG. 7. In practice, however, it has been shown that the transition is dragging in this case and that cavitation sounds could not be heard even at a much higher rotation speed. This is probably caused by the fact that dynamic influences cause a continuing slight increase of pressure from the feed cell position 17.1 to position 17.3.

FIG. 2 shows a considerably enlarged section through the centrifugal force ball check valve assembly of FIG. 1. Here, the hollow gear consists of two halves which are soldered or welded along the separation plane indicated by the separation lines 27 and 28. To the left and to the right of the ball 29, by-pass channels 30 are provided so that a sufficient passage cross-section is provided at 30 if the valve seat is open.

In the embodiment shown in FIGS. 3 and 4 the overflow channels 33, 34 in the teeth of the pinion have been created by drilling. The pinion which in this case, for example, has been made of steel is undivided. In order to form the check valve, a cavern 35 having a supporting edge 32 has been worked into the teeth starting from the front space of the pinion, which serves to guide the ball 36 during the closing movement just as is the case in the construction according to FIGS. 4 and 5 which will be described below. If the cavern is not produced by sintering, which is the cheapest way, it can also be milled by means of an N-C controlled milling machine. The overflow channels 33 and 34 can simply be drilled here. Also, the balls 36 are automatically centered and pressed to the valve seat by the centrifugal force and the hydrostatic force. The housing wall 37 prevents them from falling out.

As can be seen from the drawings, the channels with the ball valves should always be arranged in such a way that the centrifugal force alone aims to press the valve balls to their respective seats. This means that, in a preferred embodiment, the valve channels should be curved in such a way that the movement of the ball, as is the case in FIG. 1, has a substantial radial component. In the absence of such a possibility one can use a supporting edge 32 around which edge the ball can be tilted so that the ball is first pressed against the supporting edge by the centrifugal force and then, still under the influence of said centrifugal force, can swing around this edge to its position closing the seat of the valve.

In the embodiment shown in FIGS. 5 and 6 the overflow channels and check valves are positioned inside the hollow gear, but are formed more favourably with regard to flow than is the case in the embodiment according to FIGS. 1 and 2. For this purpose, a supporting edge 32 is provided which edge generates a tangential closing force component caused by the centrifugal force so that the valve seat has a tangential action line C—C. Such an embodiment is recommended in cases where the set of gears has to be very broad. In that case, considerably more oil must flow through the check valves at low rotating speed and unthrottled operation.

Inexpensive production of gears equipped with overflow channels and check valves according to FIGS. 1 and 2 as well as 5 and 6 can be effected by axial separation of the gears, the two halves of the gear being produced by a powder metallurgy method. Since the durability of such components produced by a powder metallurgy method is limited, the pressure performance of the pump is limited in this case.

If one wants to avoid the disadvantages of a powder metallurgy method, one can manufacture the pump according to FIGS. 3 and 4.

I claim:

1. A method of producing a gear including overflow channels with each overflow channel having a valve seat for receiving a check valve to close that overflow channel for a suction-controlled gear ring pump, comprising the steps of:

forming each of two half gear members with one-half of the overflow channels and valve seats in a reverse, mirror image form of the overflow channels and valve seats in the other half gear member by powder metallurgy, and mating the two half gear members in face to face relationship with one-half of the overflow channels and valve seats in each half gear member cooperating with the mirror image form of the overflow channels and valve seats in the other half gear member.

2. The method of producing a gear as defined by claim 1, and including the step of joining the mated two half gear members together by explosion welding.

3. The method of producing a gear as defined by claim 1, and including the step of joining the mated two half gear members together by sintering.

* * * * *